US006923360B2

(12) United States Patent
Sesek et al.

(10) Patent No.: US 6,923,360 B2
(45) Date of Patent: Aug. 2, 2005

(54) ADJUSTABLE STAPLER AND METHODS ASSOCIATED THEREWITH

(75) Inventors: Robert Sesek, Meridian, ID (US); Chet Butikofer, Meridian, ID (US)

(73) Assignee: Hewlett-Packard Development Company, L.P., Fort Collins, CO (US)

( * ) Notice: Subject to any disclaimer, the term of this patent is extended or adjusted under 35 U.S.C. 154(b) by 304 days.

(21) Appl. No.: 10/210,356

(22) Filed: Jul. 31, 2002

(65) Prior Publication Data

US 2004/0020963 A1 Feb. 5, 2004

(51) Int. Cl.[7] ..... B25C 5/04

(52) U.S. Cl. ..... 227/82; 227/88; 227/109; 227/155

(58) Field of Search ..... 227/82, 109, 86, 227/88, 91, 93, 97, 155

(56) References Cited

U.S. PATENT DOCUMENTS

| | | | |
|---|---|---|---|
| 3,009,618 | A | 11/1961 | Lerner |
| 3,016,538 | A | 1/1962 | Oussani |
| 3,279,673 | A | 10/1966 | Schafroth et al. |
| 3,314,581 | A | 4/1967 | Kapitanov et al. |
| 3,543,987 | A | 12/1970 | Novak et al. |
| 3,602,414 | A | 8/1971 | Garfinkel |
| 3,641,652 | A | 2/1972 | Arnold et al. |
| 3,728,774 | A | 4/1973 | Steller |
| 3,746,236 | A | 7/1973 | Perlman |
| 3,758,738 | A | 9/1973 | Otani et al. |
| 3,855,688 | A | 12/1974 | Knohl |
| 3,958,738 | A | 5/1976 | Tremblay |
| 3,971,969 | A | 7/1976 | Wines et al. |
| 4,139,136 | A | 2/1979 | Catalano |
| 4,304,349 | A | 12/1981 | Novak et al. |
| 4,318,555 | A | 3/1982 | Adamski et al. |
| 4,356,947 | A | 11/1982 | Marshall et al. |
| 4,421,264 | A | 12/1983 | Arter et al. |
| 4,610,386 | A | 9/1986 | Augostini |
| 4,810,952 | A | 3/1989 | Cohen |
| 4,877,172 | A | 10/1989 | Franklin et al. |
| 5,004,142 | A | 4/1991 | Olesen |
| 5,018,656 | A | 5/1991 | Phelps |
| 5,076,483 | A | 12/1991 | Olesen |
| 5,147,080 | A | 9/1992 | Assink et al. |
| 5,219,111 | A | 6/1993 | Bilotti et al. |
| 5,273,199 | A | 12/1993 | Logtens |
| 5,320,335 | A | 6/1994 | Iwata et al. |
| 5,346,114 | A | 9/1994 | Udagawa et al. |
| 5,454,503 | A | 10/1995 | Udagawa et al. |
| 5,560,529 | A | 10/1996 | Udagawa et al. |
| 5,575,415 | A | 11/1996 | Sucher |
| 5,676,299 | A | 10/1997 | Yoshie et al. |
| 5,938,388 | A | 8/1999 | Bloser et al. |
| 6,050,470 | A | 4/2000 | Feesenmayr et al. |
| 6,076,720 | A | 6/2000 | Deng |
| 6,119,911 | A | 9/2000 | Funk et al. |
| 6,321,935 | B1 | 11/2001 | Yoshie |
| 6,547,230 | B2 * | 4/2003 | Sato ..... 270/58.08 |

OTHER PUBLICATIONS

Adams et al., Stapler for Forming Staples to Various Sizes, Dec. 21, 2000, World Intellectual Property Organization, WO 00/76730 A1.*

* cited by examiner

*Primary Examiner*—Scott A. Smith
*Assistant Examiner*—Gloria R. Weeks
(74) *Attorney, Agent, or Firm*—Hewlett-Packard Company

(57) ABSTRACT

Disclosed herein is a stapler for forming staples according to a thickness of a stack and clinching the stack with at least one of the formed staples.

12 Claims, 11 Drawing Sheets

ADJUSTABLE STAPLER AND METHODS ASSOCIATED THEREWITH

BACKGROUND

One of the most common devices found in offices all over the world is the stapler. Staplers have been used for years to fasten a plurality of sheets of media together using a thin, U-shaped piece of wire, which is known as a staple. The base of the U-shaped staple is known as the crown, with the legs of the U forming the staple legs. Sheets of media to be fastened together are placed on top of a clinching anvil having recesses formed in the top side thereof. The recesses function as a forming tool to form clinches on the bottoms of the legs, thereby fastening the plurality of sheets of media together.

A cassette designed to hold a plurality of staples therein is conventionally used to supply the stapler with staples. Staples disposed in the cassette are biased toward an end of the cassette, which is located over the clinching anvil. The cassette supports the plurality of staples on a bottom side of the crowns of the staples, with a single staple extending into a fixed slotted aperture located in the end of the cassette. The slotted aperture is located over the anvil, with the slotted aperture being aligned with the recesses in the clinching anvil. The staple extending into the slotted aperture in the end of the cassette is unsupported on the bottom side of its crown.

A driving member, which is typically a thin driving blade, extends into the slotted aperture from the top of the cassette. The driving member is located above the staple extending into the slotted aperture in the end of the cassette. The driving blade is driven into contact with the top side of the crown of the staple extending into the slotted aperture in the end of the cassette. The driving blade may then drive the staple legs into and through the plurality of sheets of media located adjacent to the clinching anvil. After the staple legs pass through the media, the legs contact the recesses disposed in the top side of the clinching anvil. When the staple legs extend into the recesses in the clinching anvil, they are clinched, typically towards each other, to thereby retain the staple in the plurality of sheets of media to keep the plurality of sheets of media together.

The driving blade is driven by hand in simple desktop staplers, often with a single swift impact from the user's hand. This impact is usually more than sufficient to drive the staple into the sheets of media and to clinch it on the bottom of the media. In a slightly more sophisticated stapler, the impact is provided electromechanically. Sheets of media may be inserted into position against the clinching anvil at which time an electrical trigger may cause operation of the driving blade. In heavy-duty industrial applications, a stapler may even be operated using pneumatic pressure to operate the driving blade.

Many conventional staplers have at least one cassette containing a row of preformed staples of a particular size (i.e. the staples are already bent into a generally U-shaped configuration). Most conventional staplers are designed to drive a staple of one particular leg size only, with that size staple being best applied to use to fasten together a specific range of numbers of sheets of media.

For example, a short leg (one-quarter inch, for example) staple may be used to fasten from two to twenty-five sheets of standard 20# media together. If a greater number of sheets of media are to be fastened together using a short staple, they will not be fastened together securely because the staple legs are too short. Similarly, a long leg (three-quarter inch, for example) staple may be used to fasten from fifty to one hundred and fifty sheets of standard 20# media together. If a smaller number of sheets of media are to be fastened together using a long leg staple, the staple legs will be over-clinched. An over-clinched staple may have legs that extend through the sheets of media in an undesirable manner.

SUMMARY

In one exemplary embodiment disclosed herein, an apparatus and method may include: providing a stapler; forming at least one first staple in the stapler; forming at least one second staple in the stapler; wherein each of the first and second staples has at least a pair of leg portions joined by a crown portion and wherein the crown portion defines a crown length; and wherein the crown length of the first staple is different from the crown length of the second staple.

BRIEF DESCRIPTION OF THE DRAWING

Illustrative embodiments are shown in Figures of the drawing in which.

DETAILED DESCRIPTION

Staplers may be provided as an integral component of printing and/or binding devices such as printers, copy machines, facsimile machines, automated folding machines, etc. Staplers may also be provided as stand-alone products that are operated either manually or electromechanically. The present disclosure describes an automated stapler contained within a printer for exemplary purposes. It is to be understood, however, that the apparatus and methods disclosed herein may alternatively be utilized in conjunction with any of the devices previously mentioned or other equipment in which media is handled.

Figure 1:
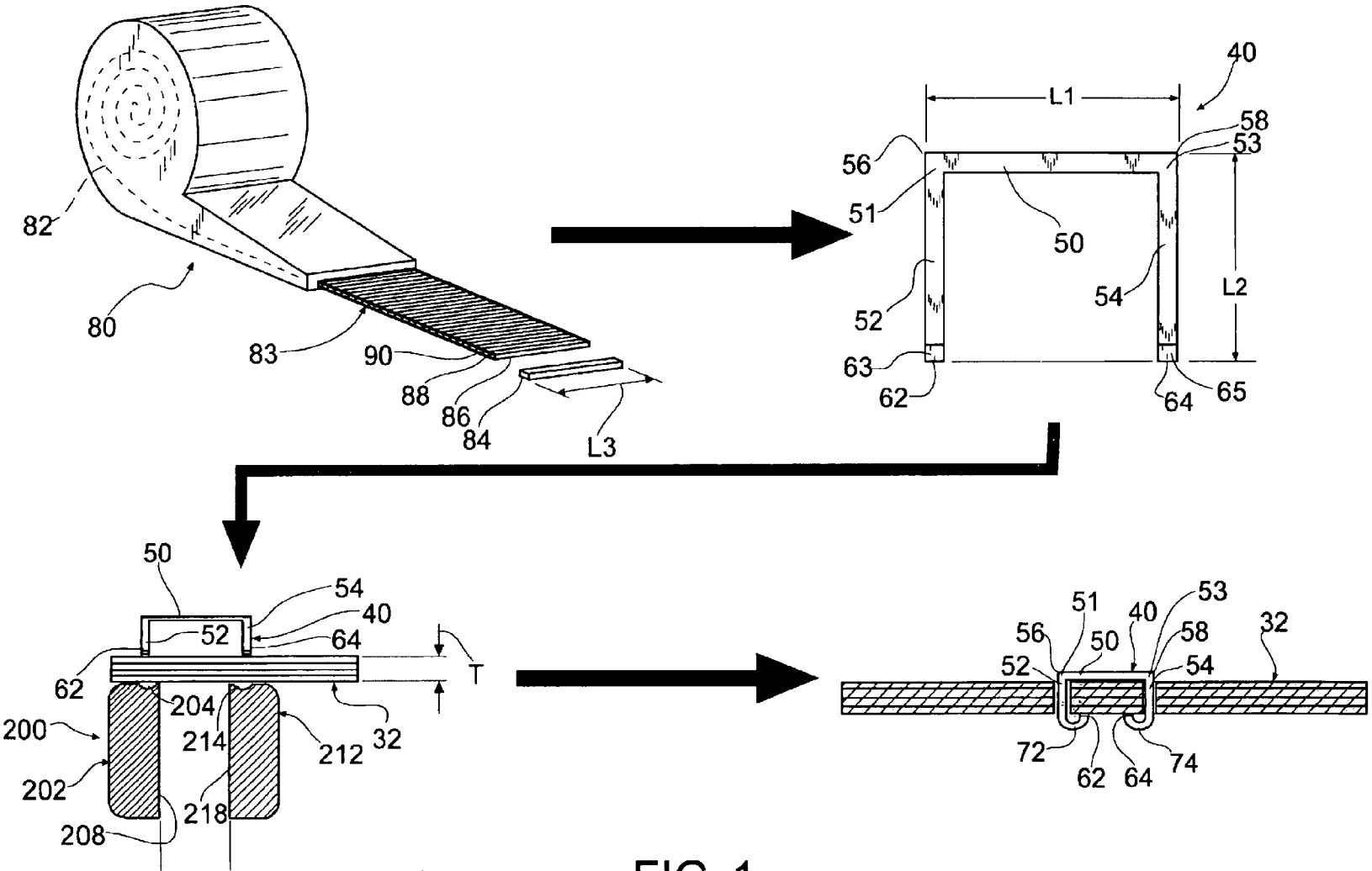
FIG. 1 shows a schematic illustration of a process for forming a staple and clinching a stack of media.

FIG. 1 illustrates a process in which staple preforms 83 are used to secure a stack 32 of media. As will be explained in further detail herein, a coil 82 of staple preforms 83 may be fed from a cartridge 80 into a stapler 100 (FIGS. 7, 8, 9 and 18). The stapler 100 converts one of the preforms 83 (e.g. preform 84) into a generally U-shaped staple 40 (also shown, for example, in FIG. 4) before being utilized to clinch the stack 32 of media. Thereafter, the stapler 100 drives the staple 40 into the stack 32 of media and clinches it in place (as also generally shown in FIGS. 2 and 3) in order to secure the media together. Accordingly, the stapler 100 is capable of accepting straight preforms 83, converting these to U-shaped staples (e.g. staple 40) and driving and clinching these staples in order to secure together a stack of media, such as the stack 32. In a process that will be described herein, the staple 40 can be formed from the preform 84 according to the thickness of the stack 32 of media. In particular, a crown length L1 may be determined and formed according the thickness of the stack 32. By varying the crown length L1, a leg length L2 is modified in a manner that will be described herein.

Figure 2:
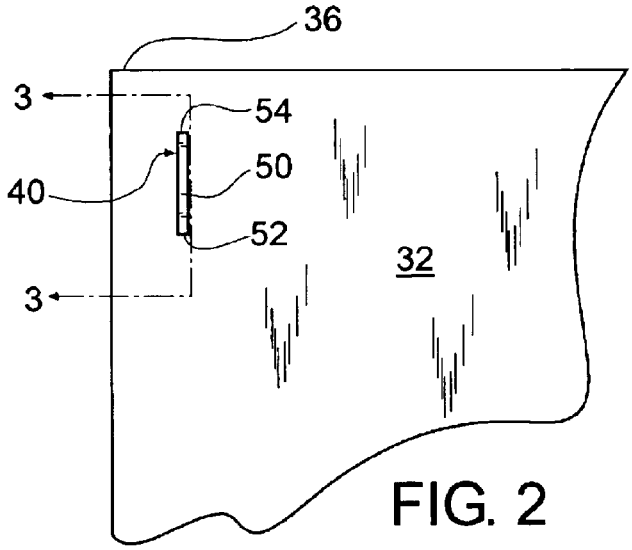
FIG. 2 shows a top plan view of a stack of media clinched by a staple.

With reference to FIG. 2, the stack 32 is shown clinched by the staple 40. As used herein, the term 'clinch' means securing individual items (e.g. sheets of media) to each other. The staple 40 may, for example, be located near a corner 36 of the stack 32 as illustrated in FIG. 2. As an alternative, the staple 40 may be located at any other location on the stack, such as, for example, a spine of a pamphlet, a top edge of the stack 32, or other locations that those skilled in the art will appreciate.

Figure 3:
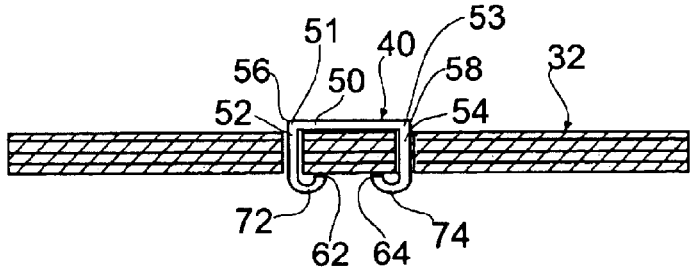
FIG. 3 shows a cross-sectional view, taken across plane 3—3 of FIG. 2, wherein the stack of media is clinched by the staple.

With reference to FIG. 3 illustrating a cross-sectional view of the stack 32 taken across plane 3—3 of FIG. 2., the staple 40 may include a crown 50, a first leg 52 and a second leg 54. The first and second legs 52, 54 may be attached to (e.g. integrally formed with) the crown 50. The staple crown 50 may have a first distal end 51 and an oppositely disposed second distal end 53. The first distal end 51 of the crown 50 may have a first bend 56 formed therein. The second distal end 53 of the crown 50 may have a second bend 58 formed therein. The first leg 52 may be attached to the crown 50 at the first bend 56. The second leg 54 may be attached to the crown 50 at the second bend 58.

Figure 4:
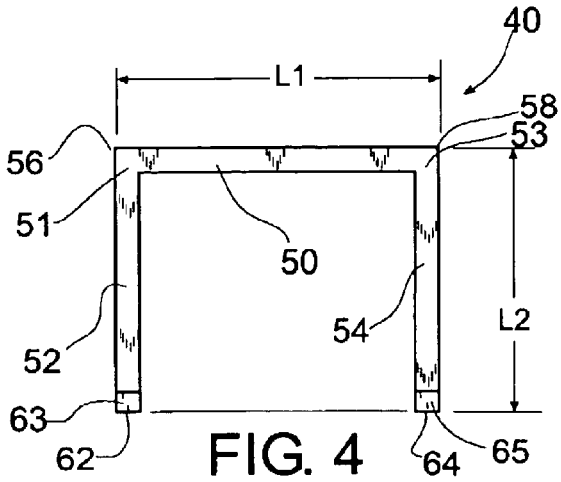
FIG. 4 shows a side elevation view of an exemplary staple.

FIG. 4 illustrates the staple 40 in a condition before it has been clinched. This staple 40 may define a first distal end 62 and a second distal end 64. The first distal end 62 may be located on the first leg 52. The second distal end 64 may be located on the second leg 54. The staple 40 may be provided with a first penetrating end 63 formed on the first distal end 62. The staple 40 may also be provided with a second penetrating end 65 formed on the second distal end 64. The penetrating ends 63, 65 may take the form of 'points'. Each point may, for example, be formed as a tapered reduction in the cross-sectional area of the respective leg.

With continued reference to FIG. 4, the crown 50 may define a crown length 'L1'. The first and second legs 52, 54 may be substantially equal in length, this leg length is denoted by 'L2'. In a process that will be described herein, these lengths L1, L2 will be created according to the thickness of a stack to be clinched.

Figure 5:
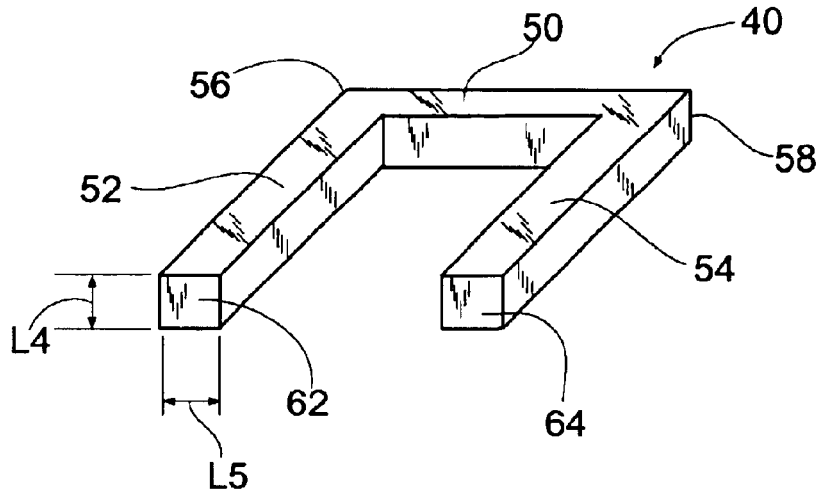
FIG. 5 shows a perspective view of an exemplary staple.

FIG. 5 also illustrates the staple 40 in the condition before it has been clinched. The staple crown 50, first leg 52 and second leg 54 may have substantially uniform cross-sectional profiles because they may be formed from a preform (e.g. preform 84, FIG. 6). This cross sectional profile of the staple 40 may define a preform width 'L4' and a preform thickness 'L5'. In one exemplary, non-limiting embodiment, the preform width L4 may be about 0.020 inches and the preform thickness L5 may be about 0.015 inches. It is noted that the preform width L4 and the preform thickness L5 are provided for illustrative purposes only and that other dimensions may be utilized depending on the particular application, staple material, properties of the media, etc.

With reference again to FIG. 3 showing a cross-sectional view taken across plane 3—3 of FIG. 2, the stack 32 may be clinched with the staple 40. In a process to be described later herein, the stack 32 may be fastened by forming a first clinch 72 and a second clinch 74 in the staple 40. The first clinch 72 may be formed in the first distal end 62. The second clinch 74 may be formed in the second distal end 64. The stack 32 may be secured between the crown 50 and the clinches 72, 74.

Figure 6:
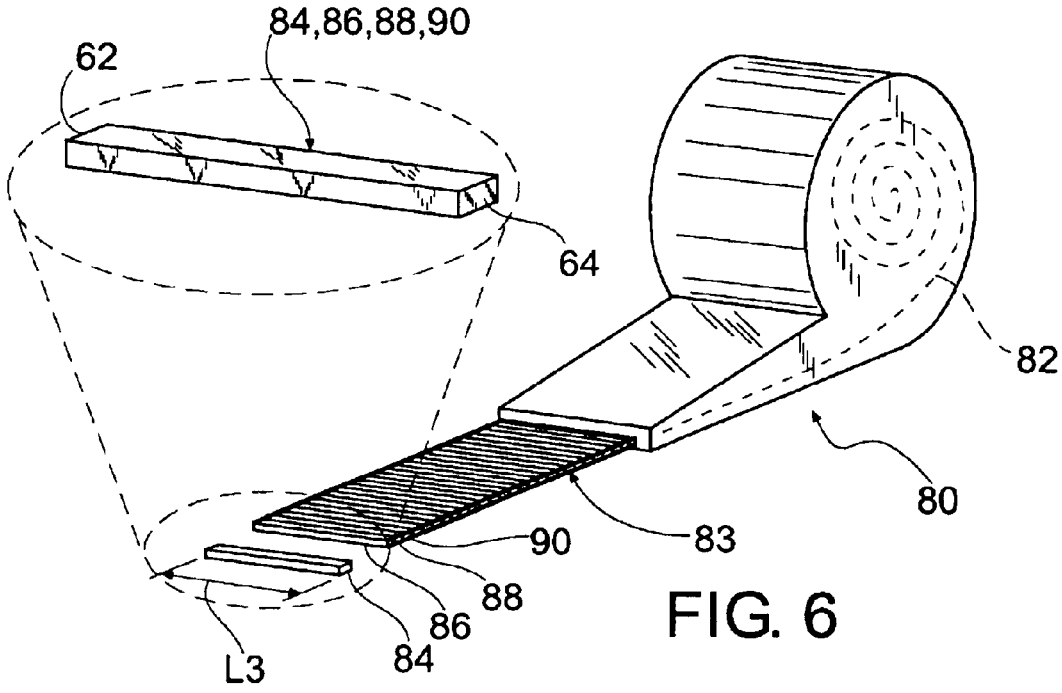
FIG. 6 shows a perspective view of one type of preform cartridge from which preforms may be supplied.

With reference to FIG. 6, the staple cartridge 80 may be provided for supplying staple preforms 83 to the stapler 100 (FIGS. 7, 8, 9 and 18). As shown in FIG. 6, the cartridge 80 may include the coil 82 of the plurality of staple preforms 83 such as individual preforms 84, 86, 88, 90, etc. The preforms 83 may be supplied from the cartridge 80 into the stapler in an unbent, relatively straight configuration defining the preform length L3. These preforms 83 may be adhered to each other by any one of a variety of adhesives. Cartridges, such as cartridge 80, are well known in the art, such as those documented in the following references: U.S. Pat. No. 5,454,503, to Udagawa et al.; U.S. Pat. No. 5,346,114, to Udagawa et al.; U.S. Pat. No. 3,602,414, to Garfinkel; U.S. Pat. No. 5,560,529 to Udagawa et al.; U.S. Pat. No. 3,279,673, to Schafroth et al.; U.S. Pat. No. 5,273,199 to Logtens; U.S. Pat. No. 3,009,618 to Lerner; and U.S. Pat. No. 5,676,299 to Yoshie et al., which are all hereby specifically incorporated by reference for all that is disclosed therein.

Figure 7:
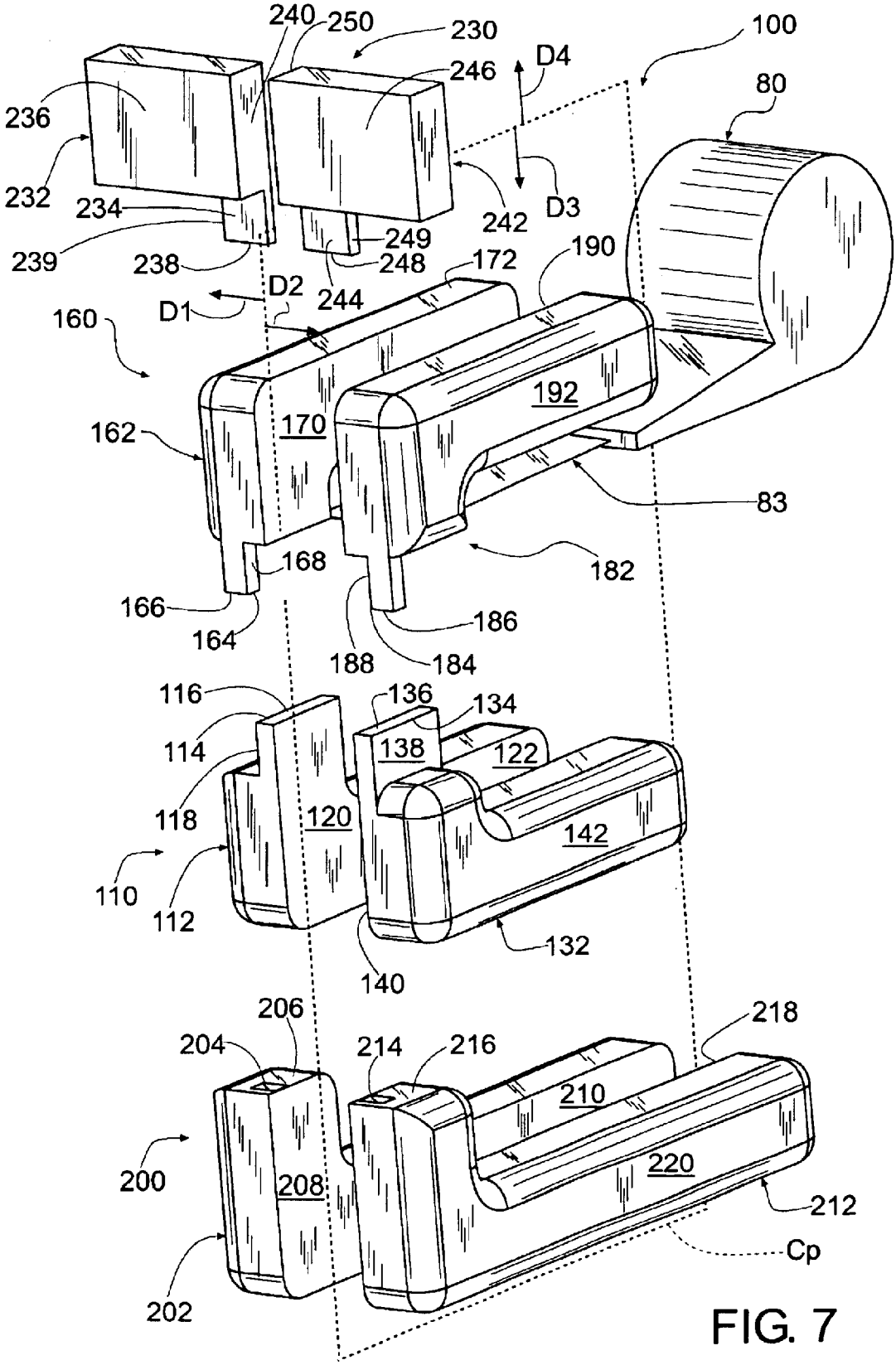
FIG. 7 shows a perspective view, in an exploded state, of an exemplary stapler utilized for forming staples and clinching stacks.
Figure 8:
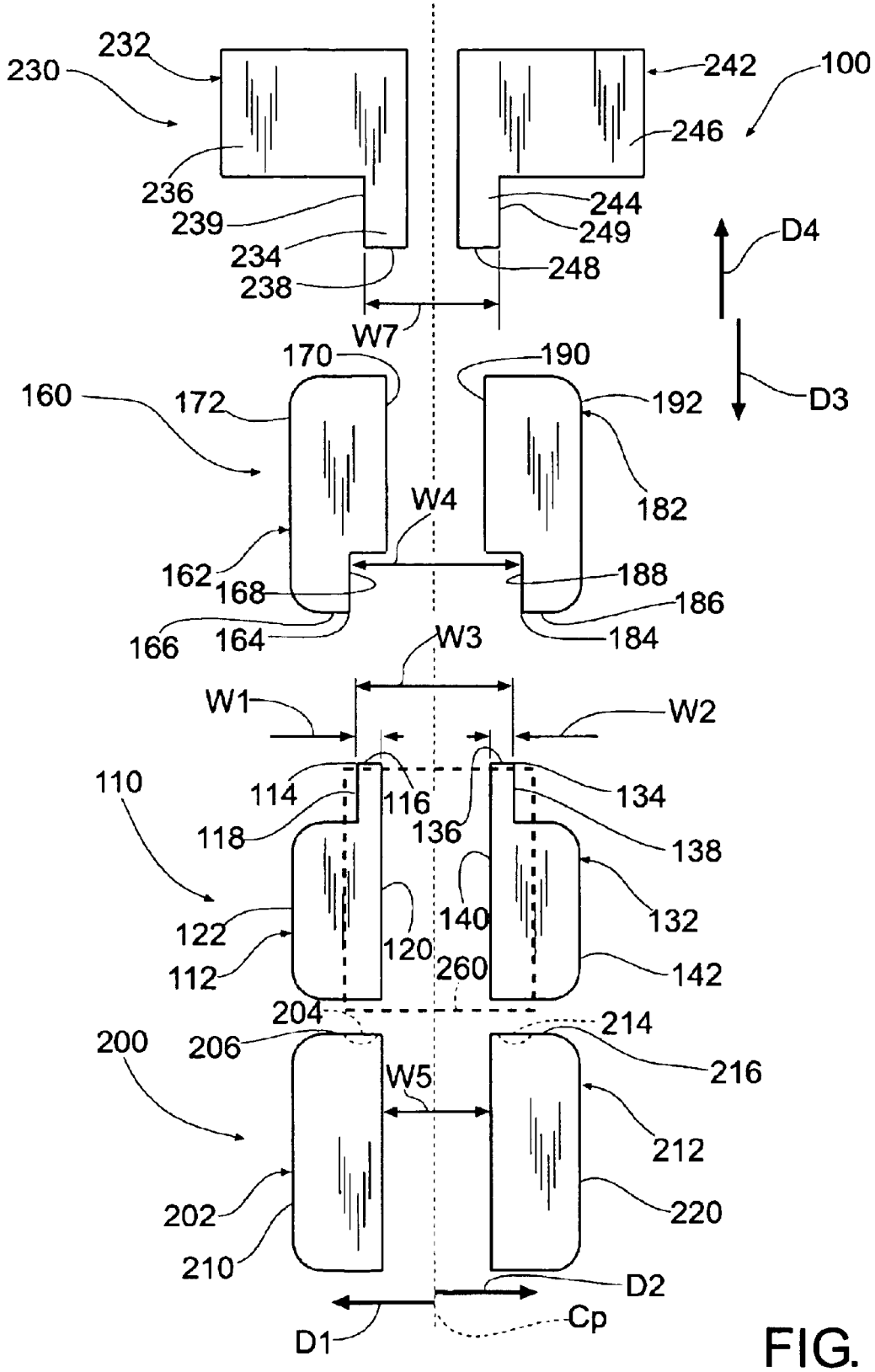
FIG. 8 shows a front elevation view of the exemplary stapler of FIG. 7.
Figure 9:
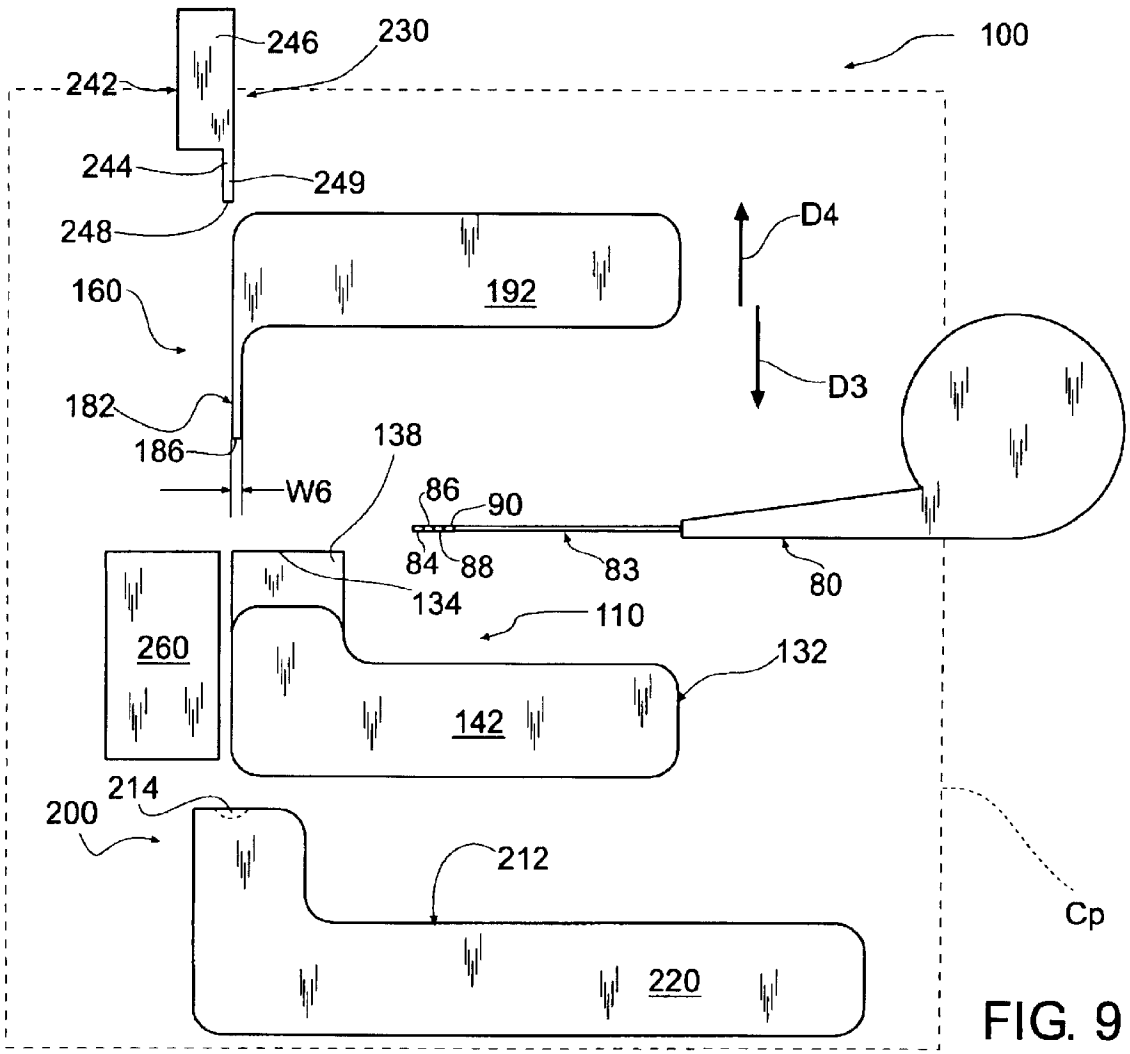
FIG. 9 shows a side elevation view of the exemplary stapler of FIG. 7.

FIGS. 7–9 show one exemplary type of stapler 100 that may include a forming anvil 110, a die assembly 160, a clinching assembly 200 and a driving assembly 230 and an aperture 260.

With reference to FIG. 7, the forming anvil 110, the die assembly 160, the clinching assembly 200 and the driving member 222 may be oriented about a central plane denoted by 'Cp' in the figures. A first direction D1 and an oppositely disposed second direction D2 may extend perpendicularly to the central plane Cp as shown. A third direction D3 and an oppositely disposed fourth direction D4 lie within the central plane Cp and are perpendicular to the first direction D1 and the second direction D2.

It is to be understood that terms such as 'front', 'back', 'top', 'bottom', 'horizontal', 'vertical' and the like are used herein for illustrative purposes only. In actual use, the stapler 100 can be configured in almost any orientation, thus making terms such as 'front', 'back', 'top', 'bottom', 'horizontal' and 'vertical' relative to the orientation of the stapler 100.

With continued reference to FIG. 7, the forming anvil 110 may include a first member 112 and a second member 132. The first member 112 may have a forming corner 114 located at an intersection of a forming face 116 and a vertical wall 118. The first member forming face 116 may define a first forming face width 'W1' (FIG. 8). In one exemplary, non-limiting embodiment, the first forming face width W1 may be about 0.10 to 0.25 inches. The first member forming corner 114 may take the form of a sharp corner with minimal radius as depicted in the figures. The forming anvil first member 112 may have a mating face 120 oriented substantially parallel to the central plane Cp. The forming anvil first member 112 may include a base portion 122. The base portion 122 may include provisions for accepting mechanical manipulation by any one of a variety of devices such as linear actuators, pneumatic cylinders, four-bar linkages, direct current or stepper motors, rack-and-pinion devices, hydraulics, or other devices. For illustrative purposes only, mechanical manipulation of the base portion 122 and other elements of the stapler 100 will be described as utilizing motors, such as direct current motors (not shown). The first member 112 may be movably attached within the stapler 100 such that the first member 112 may move in the first direction D1 and the second direction D2. As can be appreciated, such movement of the first member 112 in the first direction D1 will move the mating face 120 away from the central plane Cp. Alternatively, the first member 112 may be moved in the second direction D2 to move the mating face 120 towards the central plane Cp.

With continued reference to FIG. 7, the forming anvil second member 132 may have a forming corner 134 located at the intersection of a forming face 136 and a vertical wall 138. The second member forming face 136 may have a second forming face width 'W2' (FIG. 8). In one exemplary, non-limiting embodiment, the second forming face width W2 may be about 0.10 to 0.25 inches. The second member forming corner 134 may take the form of a sharp corner with a minimal radius. The second forming member 132 may have a mating face 140 oriented substantially parallel to the central plane Cp. The second forming member 132 may be provided with a base portion 142. The base portion 142 may include provisions for accepting mechanical manipulation by any one of a variety of devices as previously described for moving the forming anvil first member 112. The second member 132 may be movably attached within the stapler 100 such that the second member 132 may move in the second direction D2 and the first direction D1. Movement of the second member 132 in the second direction D2 may move the mating face 140 away from the central plane Cp. Alternatively, the second member 132 may be moved in the first direction D1 to move the mating face 140 towards the central plane Cp.

With reference to FIG. 8, the forming anvil first member forming corner 114 may be separated from the forming anvil second member forming corner 134 by a forming anvil separation distance W3. Variations of this forming anvil separation distance W3 result in variations of the staple crown length L1 and the leg length L2 in a manner that will be described in detail later herein.

With reference to FIG. 7, the die assembly 160 may include a first member 162 and a second member 182. The die assembly first member 162 may have a forming corner 164 located at the intersection of a forming face 166 and a vertical wall 168. The vertical wall 168 has a width denoted by 'W6' (FIG. 9) that in one exemplary embodiment may be about the width L4 (FIG. 5) of the preform 84 (e.g. 0.020 inches). The first member forming corner 164 may take the form of a sharp corner with a minimal radius. The die assembly first member 162 may have a mating face 170 oriented substantially parallel to the central plane Cp. The first member 162 may include a base portion 172. The base portion 172 may include provisions for accepting mechanical manipulation by any one of the variety of devices previously mentioned, such as a direct current motor. The first member 162 may be movably attached within the stapler 100 such that the first member 162 may move in the first direction D1 and the second direction D2. Such movement of the first member 162 in the first direction D1 may move the mating face 170 away from the central plane Cp. Alternatively, the first member 162 may be moved in the second direction D2 to move the mating face 170 towards the central plane Cp. Furthermore, the first member 162 may be movable in the third direction D3 and the fourth direction D4. Such movement of the first member 162 in the third direction D3 may move the die assembly first member forming face 166 towards the forming anvil first member forming face 116. Alternatively, the first member 162 may be moved in the fourth direction D4 to move the die assembly first member forming face 166 away from the forming anvil first member forming face 116.

With continued reference to FIG. 7, the die assembly second member 182 may have a forming corner 184 located at the intersection of a forming face 186 and a vertical wall 188. The vertical wall 188 has a width denoted by 'W6' (FIG. 9) that in one exemplary embodiment may be about the width L4 (FIG. 5) of the preform 84 (e.g. 0.020 inches). The second member forming corner 184 may take the form of a sharp corner with a minimal radius. The die assembly second member 182 may have a mating face 190 oriented substantially parallel to the central plane Cp. The second member 182 may include a base portion 192. The base portion 192 may include provisions for accepting mechanical manipulation in a manner previously described with respect to the die assembly first member 162. The second member 182 may be movably attached within the stapler 100 such that the second member 182 may move in the second direction D2 and the first direction D1. This movement may be dictated by the position of the forming anvil second member forming corner 134. Such movement of the second member 182 in the second direction D2 may serve to move the mating face 190 away from the central plane Cp. Alternatively, the second member 182 may be moved in the first direction D1 to move the mating face 190 towards the central plane Cp. Furthermore, the second member 182 may be movable in the third direction D3 and the fourth direction D4. Such movement of the second member 182 in the third direction D3 may move the die assembly second member forming face 186 towards the forming anvil second member forming face 136. Alternatively, the second member 182 may be moved in the fourth direction D4 to move the die assembly second member forming face 186 away from the forming anvil second member forming face 136.

With reference to FIG. 8, the die assembly first member forming corner 164 may be separated from the die assembly second member forming corner 184 by a die assembly separation distance W4. The die assembly separation distance W4 may be varied during an adjustment step that will be described later herein.

With reference to FIG. 7, the clinching assembly 200 may include a first member 202 and a second member 212. The clinching assembly first member 202 may include a clinching detent 204 formed in a forming face 206. The first member clinching detent 204 may have a generally circular profile. It is noted that other clinching devices may be utilized such as those described in U.S. Pat. No. 5,004,142, to Olesen which is hereby specifically incorporated by reference for all that is disclosed therein. The clinching assembly first member 202 may have a mating face 208 oriented substantially parallel to the central plane Cp. The first member 202 may also include a base portion 210. The base portion 210 may include provisions for accepting mechanical manipulation by any one of the variety of devices previously mentioned, such as a direct current motor. The first member 202 may be movably attached within the stapler 100 such that the first member may move in the first direction D1 and the second direction D2. Such movement of the first member 202 in the first direction D1 may serve to move the mating face 208 away from the central plane Cp. Alternatively, the first member 202 may be moved in the second direction D2 to move the mating face 208 towards the central plane Cp.

With continued reference to FIG. 7, the clinching assembly second member 212 may have a clinching detent 214 formed in a forming face 216. The second member clinching detent 214 may be substantially similar to the previously described first member clinching detent 204. The clinching assembly second member 212 may have a mating face 218 oriented substantially parallel to the central plane Cp. The second member 212 may include a base portion 220. The base portion 220 may include provisions for accepting mechanical manipulation in a manner substantially similar to that described with respect to the clinching assembly first member 202. The second member 212 may be movably attached within the stapler 100 such that the second member 212 may move in the second direction D2 and the first direction D1. Such movement of the second member 212 in the second direction D2 may serve to move the mating face 218 away from the central plane Cp. Alternatively, the second member 212 may be moved in the first direction D1 to move the mating face 218 towards the central plane Cp.

With reference to FIG. 8, the clinching assembly first member 202 may be separated from the clinching assembly second member 212 by a clinching assembly separation distance W5. The clinching assembly separation distance W5 may be varied during an adjustment step that will be described later herein.

With reference to FIG. 7, the driving assembly 230 may include a first member 232 and a second member 242. The driving assembly first member 232 may be provided with a blade portion 234 and a base portion 236. The blade portion 234 may be integrally formed on the base portion 236. Furthermore, the blade portion 234 may be provided with a driving surface 238 and a guide surface 239. The guide surface 239 may be substantially perpendicular to the driving surface 238. The base portion 236 may be further provided with a mating face 240 oriented substantially parallel to the central plane Cp. The base portion 236 may include provisions for accepting mechanical manipulation by any one of the variety of devices previously mentioned, such as a direct current motor. The first member 232 may be movably attached within the stapler 100 such that the first member 232 may move in the first direction D1 and the second direction D2. Such movement of the first member 232 in the first direction D1 may move the mating face 240 away from the central plane Cp. Alternatively, the first member 232 may be moved in the second direction D2 to move the mating face 240 towards the central plane Cp. Furthermore, the first member 232 may be movable in the third direction D3 and the fourth direction D4. Such movement of the first member 232 in the third direction D3 may move the driving assembly first member forming face 238 towards the clinching assembly first member forming face 206. Alternatively, the first member 232 may be moved in the fourth direction D4 to move the driving assembly first member forming face 238 away from the clinching assembly first member forming face 206.

The driving assembly second member 242 may be provided with a blade portion 244 and a base portion 246. The blade portion 244 may be integrally formed on the base portion 246. Furthermore, the blade portion 244 may be provided with a driving surface 248 and a guide surface 249. The guide surface 249 may be substantially perpendicular to the driving surface 238. The base portion 246 may be further provided with a mating face 250 oriented substantially parallel to the central plane Cp. The base portion 246 may include provisions for accepting mechanical manipulation by any one of the variety of devices previously mentioned, such as a direct current motor. The second member 242 may be movably attached within the stapler 100 such that the second member 242 may move in the first direction D1 and the second direction D2. Such movement of the second member 242 in the first direction D1 may move the mating face 250 away from the central plane Cp. Alternatively, the first member 242 may be moved in the second direction D2 to move the mating face 250 towards the central plane Cp. Furthermore, the second member 242 may be movable in the third direction D3 and the fourth direction D4. Such movement of the second member 242 in the third direction D3 may move the driving assembly second member forming face 248 towards the clinching assembly second member forming face 216. Alternatively, the second member 242 may be moved in the fourth direction D4 to move the driving assembly second member forming face 248 away from the clinching assembly second member forming face 216.

With reference to FIG. 8, the driving assembly 230 may have a driving assembly width denoted at 'W7' associated therewith. The seventh width W7 is the distance between the first member guide surface 239 and the second member guide surface 249.

As illustrated in FIG. 9, the stapler 100 may be provided with the aperture 260. The aperture 260 is provided for supporting a staple in a manner that will be described later herein.

Having provided one exemplary embodiment of the stapler 100, a process of forming the staple 40 and clinching the stack 32 with the stapler 100 will now be described. It should be noted that the immediately following forming process describes forming and clinching steps for a relatively small stack 32 (e.g. four sheets of media). In a process described later herein, the stapler 100 can be configured to form the staple 40 for a relatively thick stack 32 (e.g. twenty sheets of media).

Figure 12:
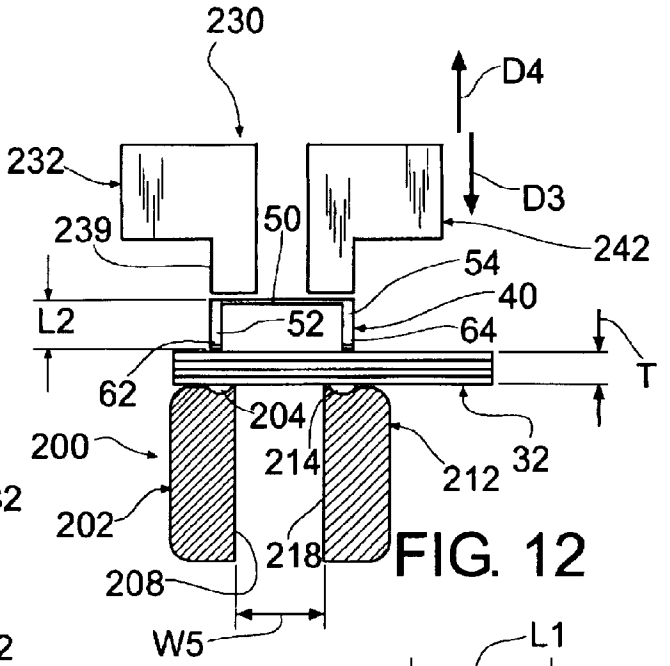
FIG. 12 shows a front elevation view, with a partial cross-section of an exemplary clinching anvil, of an exemplary stapler while a staple is being driven into a stack of media.
Figure 13:
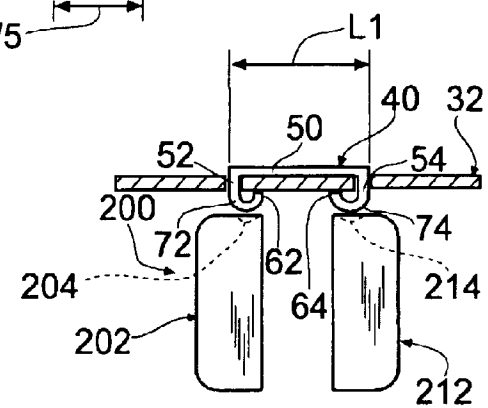
FIG. 13 shows a front elevation view, with a partial cross-section of a stack, wherein the stack of media is clinched with a staple.
Figure 11:
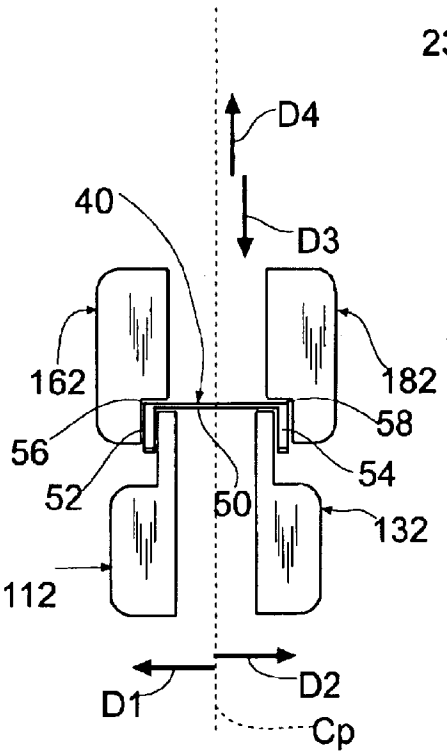
FIG. 11 shows a front elevation view of the exemplary stapler shown in FIG. 10 after the staple is formed from the preform.
Figure 10:
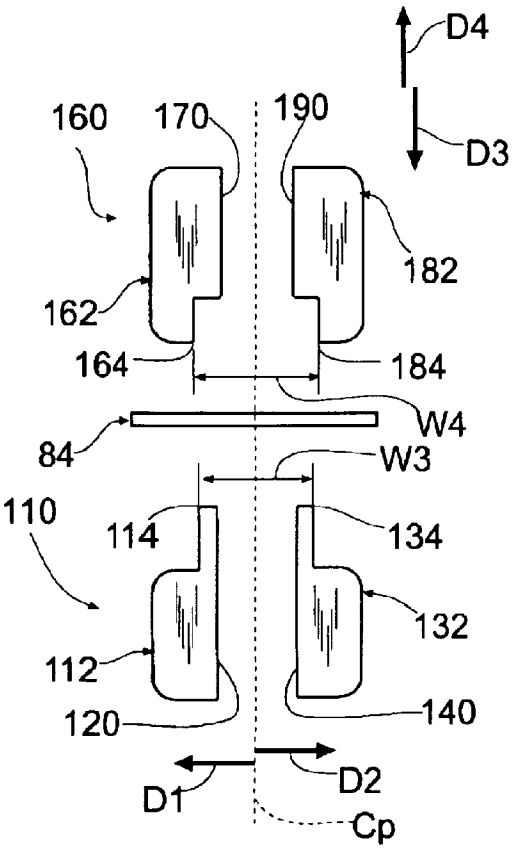
FIG. 10 shows a front elevation view of an exemplary forming anvil and die assembly of an exemplary stapler for forming a staple from a preform.

Before describing exemplary forming and clinching operations in detail, a brief overview will now be provided. FIG. 9 shows an introduction step wherein the staple preform 84 may be introduced to the stapler 100 between the forming anvil 110 and the die assembly 160 (FIG. 9 shows a side view). FIG. 10 shows an adjustment step wherein the stapler 100 may be configured for the desired leg length L2. FIG. 11 shows a forming step wherein the staple 40 may be formed from the staple preform 84. FIGS. 12 and 13 show a clinching step wherein the staple 40 may be positioned adjacent to the stack 32, driven through the stack 32 and have the clinches 72, 74 formed therein, thereby securing the individual sheets of media of the stack 32.

With reference to FIG. 9, the introduction step may begin by feeding the plurality of preforms 83 from the cartridge 80 to the stapler 100. Such introduction of the preforms 83 may result in the preform 84 being located between the forming anvil assembly 110 and the die assembly 160 (a front view of the same is shown in FIG. 10). Furthermore, the introduction of preform 84 may result in forming this preform only (and not the adjacent preform 86). This introduction of the preform 84 may occur by advancing all of the preforms 83 from the cartridge 80. In one embodiment, the preform 84 may remain attached to the adjacent preform 86 while it is formed by the following process.

With reference to FIG. 10, the adjustment step may allow for varying the crown length L1 by moving the forming anvil first and second members 112, 132. In order to form a staple 40 with a crown length L1 of 0.625, the forming anvil separation distance W3 may be about 0.575. The adjustment step may also require moving the die assembly first and second members 162, 182 to vary the die separation distance W4. As previously mentioned, a description of the adjustment step will be detailed later herein. In order to form the staple 40 with a crown length L1 of 0.625, the die separation distance W4 may be about 0.685. The adjustment step may also require moving the driving assembly first and second members 232, 242 to vary the driving assembly width W7. In order to form a staple 40 with a crown length L1 of 0.625, the driving assembly width W7 may be about 0.685. These exemplary dimensions for the forming anvil separation distance W3, the die separation distance W4 and the driving assembly width W7 are provided for descriptive purposes only, it is noted that they may be altered according to stapler configuration, preform material and dimension, or other factors.

With reference to FIG. 11, after completing the adjustment step, the forming step may commence. During the forming step, the die assembly 160 may move in the third direction D3 to process the preform 84 into the staple 40. As shown in FIG. 11, the forming of the staple 40 may occur by forming the first bend 56 and the second bend 58. The first bend 56 may be formed by bending the preform 84 between the forming anvil first member forming corner 114 and the die assembly first member forming corner 164. The second bend 58 may be formed by bending the preform 84 between the forming anvil second member forming corner 134 and the die assembly second member forming corner 184. The forming of the preform 84 may create the first and second bends 56, 58 with the first and second legs 52, 54 attached thereto. This creation of the legs 52, 54 converts the preform 84 into the staple 40.

Figure 17:
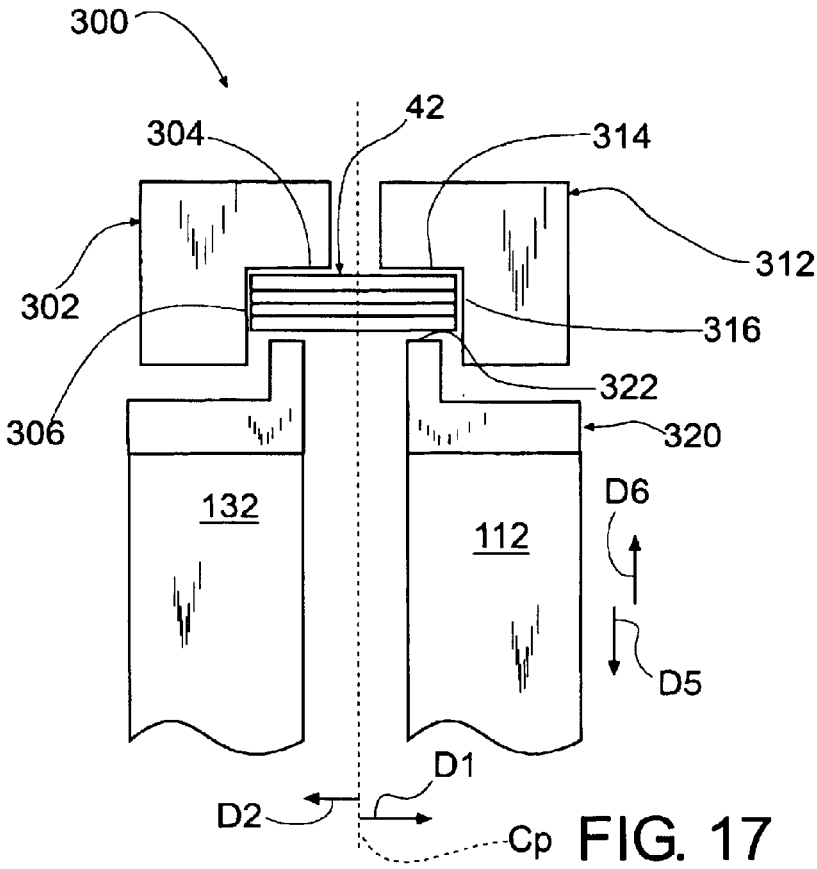
FIG. 17 shows a top plan view of an exemplary variable staple aperture.
Figure 18:
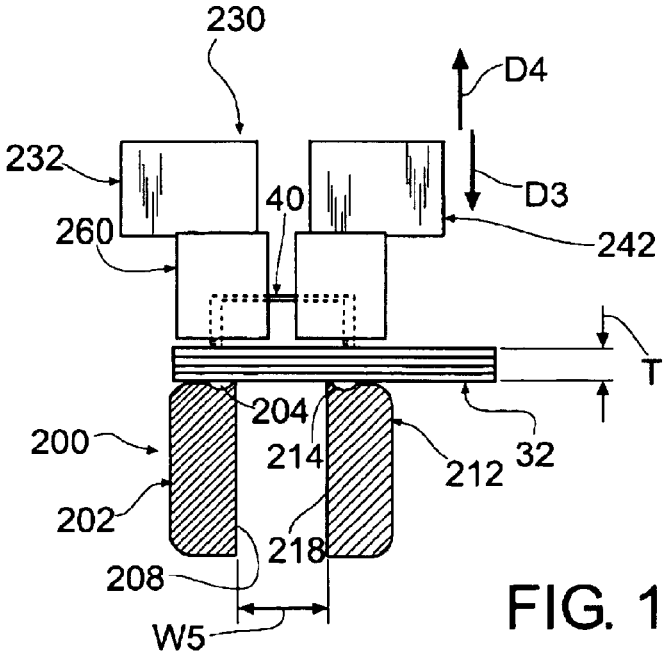
FIG. 18 shows a front elevation view of the variable staple aperture of FIG. 17.

After the forming step represented in FIG. 11 is complete, the clinching step represented in FIGS. 12 and 13 may occur. With reference to FIG. 12, at the outset of the clinching step, the staple 40 may be advanced so that it extends beyond the forming anvil 110. Since the staple is suspended beyond the forming anvil 110, the staple 40 may be separated from the adjacent preform 86. Such separation of the staple 40 from the adjacent preform 86 may occur by moving the driving member 222 in the third direction D3 into contact with the staple crown 50. After being separated from the adjacent preform 86, the staple 40 may be positioned adjacent to the stack 32. Such positioning of the staple 40 adjacent to the stack 32 may occur by moving the driving member 222 in the third direction D3 into contact with the staple crown 50. The staple 40 may be guided in the third direction D3 by a staple aperture (one variation of a staple aperture is illustrated in FIGS. 17 and 18). As the driving member 222 moves the staple 40 through the staple aperture, the staple ends 62, 64 approach the stack 32.

As shown in FIG. 12, once the staple ends 62, 64 contact the stack 32, the driving member 222 may begin to push the staple ends 62, 64 into the stack 32. Such pushing of the staple ends 62, 64 into the stack 32 creates holes in the stack 32. Ultimately, the legs 52, 54 penetrate through the holes formed in the stack 32. As the staple legs 52, 54 emerge from the stack 32, they are received by the clinching anvil 200.

After driving the staple 40 through the stack 32, the clinching anvil 200 may be utilized in a process to fasten the stack 32 together. The clinching anvil 200 must have the first member 202 and the second member 212 separated by the clinching assembly separation distance W5, FIG. 12, based on the crown dimension L1 (FIG. 13). As previously mentioned, the crown dimension L1 is a function of the thickness of the stack 32; therefore, the separation distance W5 is a function of the thickness of the stack 32.

With reference to FIG. 13, the clinching step may continue by contacting the first leg end 62 with the clinching anvil first member clinching detent 204. The first member clinching detent 204 has a profile capable of forming the first leg end 62 into the clinch 72 while the driving member 222 urges staple 40 in the third direction D3. Forming of the clinch 72 may result in the staple end 62 being displaced adjacent to, or slightly into, the stack 32. By forming the clinch 72 in this manner, the relatively sharp end 62 is hidden so that it does not interfere with regular usages of the stack 32, such as distribution, reading, carrying, etc.

While forming the first leg clinch 72, the second leg clinch may be simultaneously formed. The second leg end 64 may meet the clinching anvil second member clinching detent 214. The second member clinching detent 214 has a profile capable of forming the second leg end 64 into the clinch 74 while the driving member 222 urges the staple 40 in the third direction D3. Forming of the clinch 74 may result in the staple end 64 being displaced adjacent to, or slightly into, the stack 32. By forming the clinch 74 in this manner, the relatively sharp end 64 is hidden so that it does not interfere with regular usages of the stack 32, such as those previously mentioned.

The immediately preceding forming and clinching process was directed to a relatively small stack 32 (e.g. four sheets of bond paper). In the event that a thicker stack of media (e.g. twenty sheets of bond paper) is to be clinched, the staple 40 may be formed with a different leg length L2. When stapling this relatively thick stack 32, the crown length L1 (FIG. 4) may be relatively small and thereby result in the leg length L2 being relatively large. By reducing the crown length L1, the longer legs 52, 54 have a proper length protruding from the stack 32. This proper length of the legs 52, 54 is utilized for creating clinches 72, 74 therefrom, respectively. The sum of crown length L1 and the two leg lengths L2 is defined as the preform length L3(FIG. 6) according to the equation: L1+L2+L2=L3. In one exemplary, non-limiting embodiment, the crown length L1 may be about 0.25 inches while the leg dimension L2 may be about 0.4375 inches for the relatively thick stack 32. It is noted that in this exemplary embodiment, the equation L1+L2+L2=L3 is satisfied because 0.25+0.4375+0.4375=1.125 inches, wherein L1 is about 0.25 inches and L2 is about 0.4375 inches.

With reference to FIG. 10, assuming that the stapler 100 is to be configured for the thicker stack 32 after being configured for the relatively thin stack, the forming anvil first and second members 112, 132 may be moved such that the forming anvil separation distance W3 (FIG. 10) is reduced during the adjustment step. Additionally, the die assembly members 162, 182 may be moved to reduce the die separation dimension W4. The clinching anvil members 202, 212 may also be moved to reduce the clinching distance W5. After configuring the stapler to form the staple 40 for the thicker stack 32, the process of forming the staple 40 and clinching the stack 32 may commence.

The process of forming the staple 40 and clinching the stack 32 may be essentially the same as previously described. Such forming of the staple 40 for the thicker stack 32 and stapling of the thicker stack 32 results in clinches 72, 74 that are hidden so that they do not interfere with regular usage of the stack 32, such as distribution, reading, carrying, etc. This process of determining the crown length L1 and leg length L2 and forming staples having the desired lengths L1, L2 may continue indefinitely according to the thickness of the stacks to be fastened.

As an alternative to the stapler 100 having movable elements (e.g. the forming anvil 110, the die assembly 160 and the clinching anvil 200), the stapler 100 may be provided with two separate sets of elements. A first set of elements may include a forming anvil, a die assembly and a clinching anvil for a small staple having relatively short leg lengths L2 (FIG. 1) for clinching relatively few pieces of paper. A second set of elements may include a forming anvil, a die assembly and a clinching anvil for a large staple having relatively long leg lengths L2 (FIG. 1) for clinching relatively large number of pieces of paper. This alternative embodiment may be configured such that movement of the sets of elements place either the first set or the second set of elements into position to be utilized for forming and clinching the staple.

As an alternative to the immediately preceding embodiment, the separate sets of elements may include more than the two sets described. In this regard, there may be several different sets of elements for forming a variety of staples. The selection of the elements to be utilized to fasten a particular stack may be determined by the thickness of the stack to be fastened. Furthermore, these elements may be configured such that movement thereof may place a particular set of elements into a position where staples may be formed therewith. Such movement may be any type of mechanical movement, such as linear movement or rotary movement.

Figure 14:
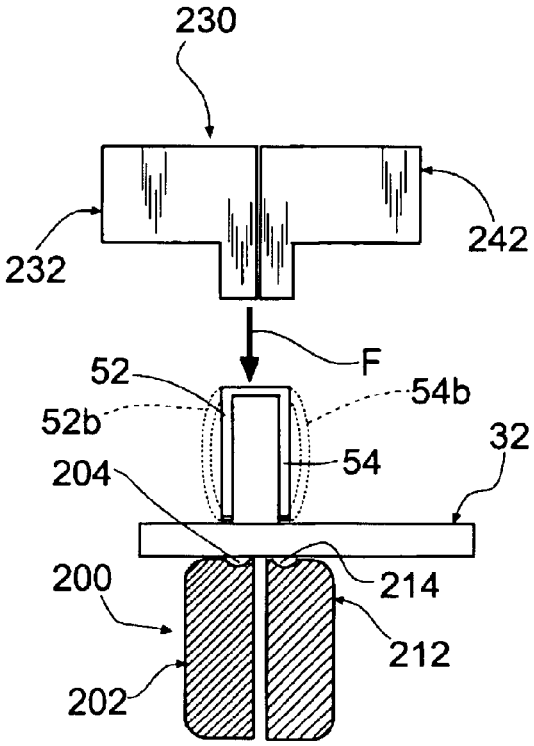
FIG. 14 shows a front elevation view of an exemplary stapler wherein a staple is subjected to a force, thereby placing the staple into a buckling condition.
Figure 15:
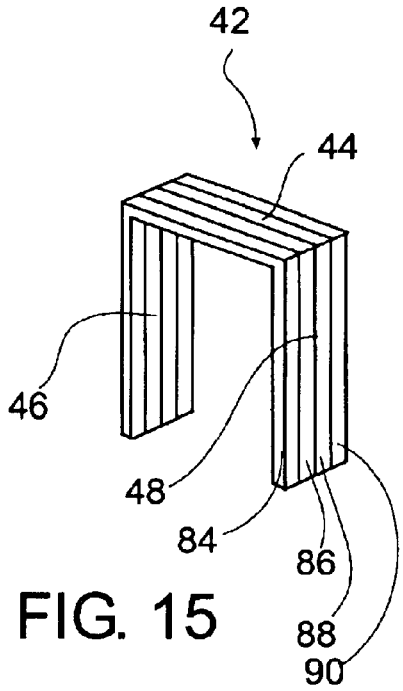
FIG. 15 shows a perspective view of an exemplary multiple-preform staple.
Figure 16:
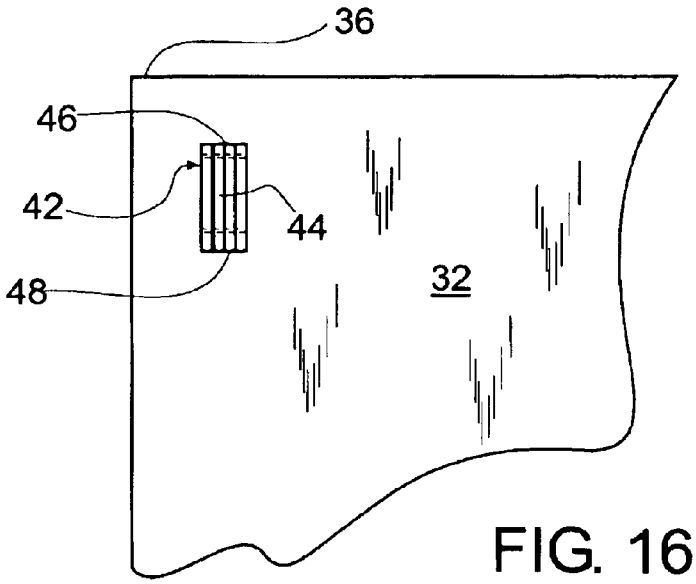
FIG. 16 shows a top plan view of a stack of media clinched by an exemplary multiple-preform staple.

In another alternative embodiment, the staple 40 may be formed with a plurality of preforms in order to minimize the possibility of 'staple buckling'. As used herein, staple buckling is defined a condition wherein a force F required to drive a staple into a stack exceeds the buckling capacity of the staple. With reference to FIG. 14, this staple buckling condition is illustrated by the dashed lines representative of the staple legs 52, 54. If the first leg 52 buckles, the first leg 52 may be crushed as represented by the dashed lines denoted by reference numeral 52*b*. In a similar manner, if the second leg 54 buckles, the second leg 54 may be crushed as represented by the dashed lines denoted by reference numeral 54*b*. The potential for occurrence of the staple buckling condition may increase as the staple leg length L2 increases. In order to minimize the propensity for buckling, a plurality of preforms may be formed and stapled as shown in FIGS. 15 and 16. The forming of a plurality of preforms may be accomplished in a similar manner to the method previously described. FIG. 15 shows a multiple-preform staple 42 formed from a plurality of preforms such as preforms 84, 86, 88, 90. Such multiple-preform staple 42 may have increased resilience to buckling due to the increase in the cross-sectional area of the multiple-preform staple 42. FIG. 16 shows the stack 32 clinched with the multiple-preform staple 42 shown in FIG. 15.

As an alternative to the immediately preceding embodiment, when making the multiple-preform staple 42 shown in FIG. 15, the preforms 84, 86, etc. may remain adhered to each other. When forming the multiple-preform staple 42, this adhesion between the preforms 84, 86, etc. is retained rather than being disrupted when separating the preforms 83 from each other. In order to retain the adhesion between the preforms 83, the preforms 83 must be formed simultaneously (rather than forming one preform at a time). In order to simultaneously form a plurality of preforms 83 at one time, the dimensions of the forming die assembly first and second member 162, 182 may be varied to increase the width W6 (FIG. 7) of the vertical walls 168, 188. Such adhesion together serves to minimize the potential for buckling by supporting each preform (e.g. 84, 86, etc) with at least the adjacent preform. Adhesive utilized to hold the multiple-preform staple 42 together may be provided at time of manufacture of the preform supply, such as cartridge 80 (FIG. 6).

In another alternative embodiment, the aperture 260 (FIG. 9) of the stapler 100 may be configured as a variable staple aperture 300 (FIGS. 17 and 18) through which staples (e.g. multiple-preform staple 42 and staple 40) may pass after forming and prior to stapling. The variable staple aperture 300 may be any one of a variety of configurations such as the configuration shown in FIGS. 17 and 18. With reference to FIG. 17, the variable staple aperture 300 may be configurable to accommodate for one or more staples (such as multiple staple 42) and varying crown lengths L1. The variable staple aperture 300 may include a first member 302, a second member 312, and a third member 320. The first member 302 may include a first surface 304 and a second surface 306, both may guide the multiple-preform staple 42. The first member first surface 304 may be positioned by moving the first member 302 in a fifth direction D5 and an oppositely disposed sixth direction D6. This positioning of the first member 302 may result in the variable staple aperture 300 forming a suitable opening for the multiple-preform staple 42 to travel there through. Likewise, the first member second surface 306 may be positioned by moving the first member 302 in the first direction D1 and the second direction D2. This positioning of the first member 302 may result in the variable staple aperture 300 forming a suitable opening for the multiple-preform staple 42 to travel there through. The second member 312 may include a first surface 314 and a second surface 316, both may guide the multiple-preform staple 42. The second member first surface 314 may be positioned by moving the second member 312 in the fifth direction D5 and the sixth direction D6. This positioning of the second member 312 may result in the variable staple aperture 300 forming a suitable opening for the multiple-preform staple 42. Furthermore, the second member second surface 316 may be positioned by moving the second member 312 in the first direction D1 and the second direction D2. This positioning of the first member 302 may result in the variable staple aperture 300 forming a suitable opening for the multiple-preform staple 42. The third member 320 may be formed on or adjacent to the forming anvil 130. The third member 320 may include a first surface 322 against which the multiple-preform staple 42 may slide. The third member first surface 322 may be stationary. By moving the first and second members 302, 312, the variable staple aperture 300 may be configured such that any one of a variety of staples may pass there through, such as multiple-preform staple 42 (FIG. 15) and staple 40 (FIG. 5). The variable staple aperture 300 may be utilized as a guide while the driving assembly 230 (FIG. 7) moves the staple (e.g. 40, 42, etc.) to the stack 32. This variable stapler aperture 300 may allow for a variety of staple configuration to be moved within the stapler 100. FIG. 18 shows a front view of the stapler 100 provided with the variable staple aperture 300. As illustrated, the driving assembly width W7 (FIG. 8) may essentially match the crown length L1 (FIG. 4) so that it can clear the variable stable aperture first and second members 302, 312. By matching the driving assembly width W7 with the crown length L1, the driving assembly driving faces 238, 248 push on the entire portion of the staple crown 50 (FIG. 4).

Figure 19:
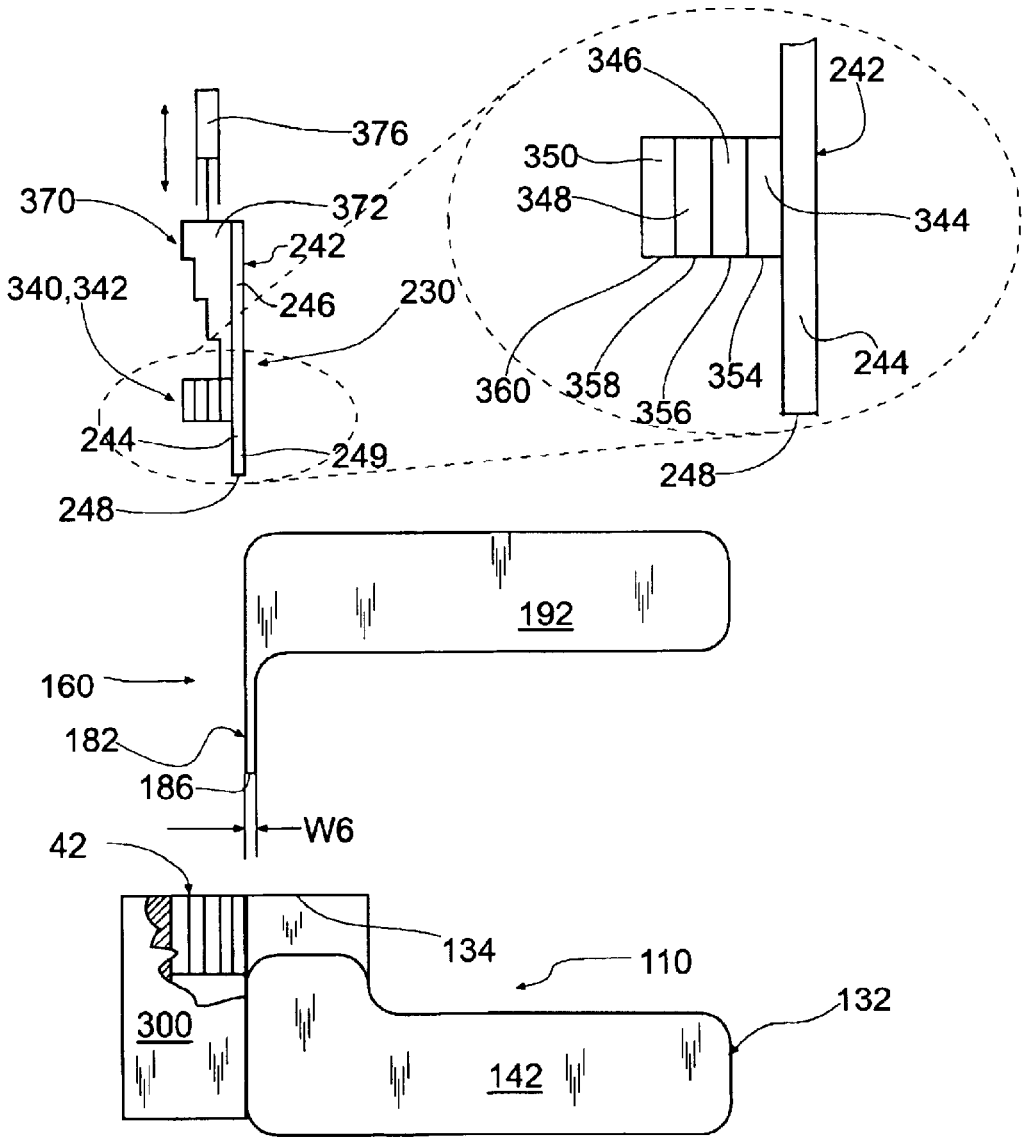
FIG. 19 shows a side elevation view of an adjustable driving assembly.

In another exemplary embodiment illustrated in FIG. 19, the driving assembly 230 may be provided with an adjustable driving assembly 340 to accommodate the multiple perform staple 42. This adjustable driving assembly 340 may be any one of a variety of configurations such as a variable plate assembly 342 configuration illustrated in FIG. 19. Each of the driving assembly members 232, 242 (FIG. 7) may be provided wit the variable plate 342. Once exemplary configuration of the variable plate assembly 342 will now described as being incorporated into the second member 242; it is to be understood that the first member 232 may also be provided with the variable plate assembly 342. The variable plate assembly 342 configuration may be provided with a first plate 344, a second plate 346, a third plate 348 and a fourth plate 350. The plates 344, 346, 348 and 350 may be provided with driving surfaces such as driving surfaces 354, 356, 358 and 360, respectively. The plate driving surfaces 354, 356, 358 and 360 may be selectively positioned such that they are coplanar with the driving surface 248. The variable plate assembly 342 may be further provided with an actuator 370 and a sequential ramp 372. The variable plate assembly may be further provided displacement element such as a linear actuator 376. The linear actuator 376 may be activated to displace the sequential ramp 372. The sequential ramp 372 may move the plates 344, 346, 348 and 350 adjacent to the driving assembly second member blade portion 244. In use, the adjustable driving assembly 340 may allow for the multiple preform staple 42 to be provided with varying number of staples (such as the five-staple multiple preform staple 42 illustrated in FIG. 19). This adjustable driving assembly 340 allows for the entire crown-portion of the multiple preform staple 42 to be pushed evenly by the driving surfaces 248, 354, 356, 358 and 360.

Figure 20:
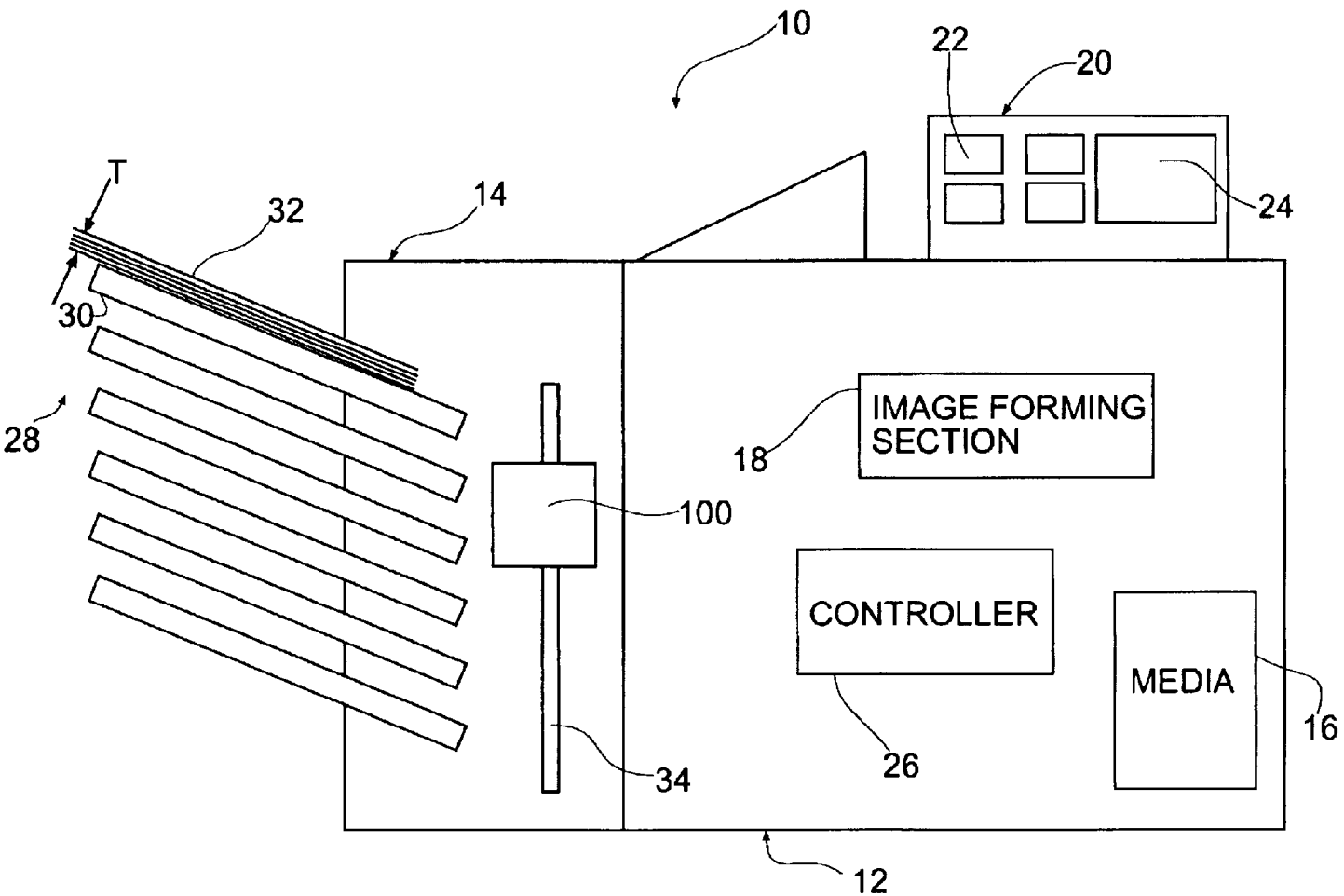
FIG. 20 shows a schematic diagram of an exemplary imaging system provided with a stapler.

In another exemplary embodiment, the stapler 100 may be provided as a component within an imaging apparatus 10, such as a printer. With reference to FIG. 20, a schematic diagram depicts a simplified side view of the exemplary imaging apparatus 10. This exemplary imaging apparatus 10 may include the stapler 100. The imaging apparatus 10 may include a main body 12 and a sorter attachment 14. The main body 12 may include a supply of sheets of one or more types of media 16, such as paper. The sheets of media 16 may be moved via a media path from the supply of sheets to an image forming section 18, where an image may be formed thereon. The image forming section 18 may be any type of imaging device known to those skilled in the art, such as a digital imaging system.

The imaging apparatus main body 12 may also include a user input station 20 which can include actuators such as buttons 22. The user input station 20 may also include a display device 24 that allows the imaging apparatus 10 to provide information to the user. The imaging apparatus 10 may also include a controller 26 which can receive instructions via the user input station 20 and can control the operation of the image forming section 18, the stapler 100, or other components of the imaging apparatus 10.

The imaging apparatus sorter attachment 14 may include a plurality of output trays 28, such as output tray 30. The output trays 28 may allow for multiple copies of a document to be separated for post imaging processing, such as stapling. The sorter attachment output tray 30 is shown holding a stack 32. As used herein, the term stack 32 is defined as a plurality of sheets of media, such as media 16. This stack 32 may define a thickness 'T' as shown in FIG. 20.

The sorter attachment 14 may include the stapler 100. In one exemplary embodiment, the stapler 100 may be configured to move somewhat vertically in the sorter attachment 14 via a drive mechanism 34. The drive mechanism 34 may allow the stapler 100 to selectively access any of the output trays 28. When selectively accessing one of the output trays 28, the stapler 100 may use the previously described process for clinching the stack 32 located therein.

It should be noted that the actual thickness of the stack 32 may be monitored by the controller 26. In this exemplary embodiment, the controller 26 may track the quantity of sheets, thickness and/or type of media processed by the imaging apparatus 10 and placed in one of the output trays 28. Such tracking may be utilized by the controller 26 to determine the configuration best-suited for the particular stack thickness T. This determination may be made by a crown-dimension algorithm associated with the controller 26. One exemplary crown-dimension algorithm may comprise multiplying the paper thickness by a predetermined constant to obtain the staple crown length L1. For example:

$$L1=C*T; \text{ where,}$$

L1 is the staple crown length;

C is the predetermined constant; and,

T is the thickness of the stack.

These various embodiments and variations thereof may be implemented in a stapler to ensure proper stapling of stacks of media while utilizing the convenience of prepackaged preforms.

While illustrative embodiments have been described in detail herein, it is to be understood that the concepts may be otherwise variously embodied and employed and that the appended claims are intended to be construed to include such variations except insofar as limited by the prior art.

We claim:

1. A stapler of the type including a forming die that cooperates with a forming anvil to bend a staple preform into a staple having at least a pair of legs connected by a crown portion extending transversely to said pair of legs, comprising:

said forming die having at least a first forming die member and a second forming die member;

said forming anvil having at least a first forming anvil member and a second forming anvil member;

wherein said first forming die member is moveable relative to said second forming die member; and wherein said first forming anvil member is moveable relative to said second forming anvil member.

2. The stapler of claim 1 and further comprising:

a driving assembly comprising a first driving assembly member and a second driving assembly member;

wherein said first driving assembly member is moveable relative to said second driving assembly member.

3. The stapler of claim 1 and further comprising:

a clinching anvil comprising a first clinching anvil member and a second clinching anvil member;

wherein said first clinching anvil member is moveable relative to said second clinching anvil member.

4. The stapler of claim 1 wherein:

said crown portion of said staple extends longitudinally in a first direction;

said first forming die member is moveable relative to said second forming die member in said first direction.

5. The stapler of claims and further wherein:

said stapler includes at least a first operating condition and a second operating condition;

wherein, in said first operating condition:

said stapler is configured to form at least a first staple having a first crown length;

at least a portion of said first forming die member is at a first distance from at least a portion of said second forming die member:

wherein, in said second operating condition:

said stapler is configured to form at least a second staple having a second crown length;

said at least a portion of said first forming die member is at a second distance from said at least a portion of said second forming die member;

wherein, said first crown length differs from said second crown length by a first amount;

wherein, said first distance differs from said second difference by said first amount.

6. A stapler of the type including a forming die that cooperates with a forming anvil to bend a staple preform into a staple having at least a pair of legs connected by a crown portion extending longitudinally in a first direction that is transverse to said pair of legs, comprising:

said forming die having at least a first forming die member and a second forming die member;

wherein said first forming die member is moveable relative to said second forming die member in said first direction.

7. The stapler of claim 6, and further comprising:

a driving assembly comprising a first driving assembly member and a second driving assembly member;

wherein said first driving assembly member is moveable relative to said second driving assembly member in said first direction.

8. The stapler of claim 6 and further comprising:

a clinching anvil comprising a first clinching anvil member and a second clinching anvil member;

wherein said first clinching anvil member is moveable relative to said second clinching anvil member in said first direction.

9. The stapler of claim 6 and further wherein:

said stapler includes at least a first operating condition and a second operating condition;

wherein, in said first operating condition:

said stapler is configured to form at least a first staple having a first crown length;

at least a portion of said first farming die member is at a first distance from at least a portion of said second forming die member;

wherein, in said second operating condition:

said stapler is configured to form at least a second staple having a second crown length;

said at least a portion of said first forming die member is at a second distance from said at least a portion of said second forming die member;

wherein, said first crown length differs from said second crown length by a first amount;

wherein, said first distance differs from said second difference by said first amount.

10. The stapler of claim 6 wherein;

said forming anvil having at least a first forming anvil member and a second forming anvil member;

wherein said first forming anvil member is moveable relative to said second forming anvil member in said first direction.

11. A method of creating a stapled document with a stapler of type including a forming die that cooperates with a forming anvil to bend a staple preform into a staple having at least a pair of legs connected by a crown portion extending longitudinally in a first direction that is transverse to said pair of legs, said method comprising:

providing said forming die having at least a first forming die member and a second forming die member;

forming at least one image on a sheet of media of a stack;

presenting said stack to said stapler;

determining a desired crown dimension for a staple, forming said staple comprising said crown dimension by moving said first forming die member relative to said second forming die member in said first direction; and stapling said stack with said staple, thereby creating said stapled document.

12. The method of claim 11 and further comprising:

providing said forming anvil having at least a first forming anvil member and a second forming anvil member;

wherein said forming said staple comprising said crown dimension further comprises moving said first forming anvil member relative to said second forming die member in said first direction.

* * * * *

UNITED STATES PATENT AND TRADEMARK OFFICE

CERTIFICATE OF CORRECTION

PATENT NO. : 6,923,360 B2
APPLICATION NO. : 10/210356
DATED : August 2, 2005
INVENTOR(S) : Robert Sesek et al.

It is certified that error appears in the above-identified patent and that said Letters Patent is hereby corrected as shown below:

Column 13, line 24, delete “wit” and insert therefor --with--

Column 13, line 26, after “now” insert --be--

Column 15, Claim 5, line 14, delete “claims” and insert therefor --claim 28--

Column 16, Claim 9, line 8, delete “farming” and insert therefor --forming--

Signed and Sealed this

Twelfth Day of December, 2006

JON W. DUDAS
*Director of the United States Patent and Trademark Office*